US009845814B2

(12) United States Patent
Akiyama et al.

(10) Patent No.: US 9,845,814 B2
(45) Date of Patent: Dec. 19, 2017

(54) HYDRAULIC DRIVE SYSTEM

(71) Applicant: KOMATSU LTD., Tokyo (JP)

(72) Inventors: Teruo Akiyama, Kokubunji (JP); Noboru Iida, Chigasaki (JP); Koji Saito, Fujisawa (JP); Takayuki Watanabe, Hiratsuka (JP); Kenji Sasano, Hiratsuka (JP)

(73) Assignee: KOMATSU LTD., Tokyo (JP)

( * ) Notice: Subject to any disclaimer, the term of this patent is extended or adjusted under 35 U.S.C. 154(b) by 355 days.

(21) Appl. No.: 14/411,265

(22) PCT Filed: Sep. 25, 2013

(86) PCT No.: PCT/JP2013/075792
§ 371 (c)(1),
(2) Date: Dec. 24, 2014

(87) PCT Pub. No.: WO2014/061407
PCT Pub. Date: Apr. 24, 2014

(65) Prior Publication Data

US 2015/0176610 A1 Jun. 25, 2015

(30) Foreign Application Priority Data

Oct. 19, 2012 (JP) ..... 2012-231357

(51) Int. Cl.
*F15B 11/042* (2006.01)
*F15B 11/044* (2006.01)
(Continued)

(52) U.S. Cl.
CPC ..... *F15B 11/0445* (2013.01); *E02F 9/2225* (2013.01); *E02F 9/2228* (2013.01);
(Continued)

(58) Field of Classification Search
CPC ... E02F 9/2289; E02F 9/2228; F15B 11/0423; F15B 2211/761; F15B 2211/785; F15B 2211/27
See application file for complete search history.

(56) References Cited

U.S. PATENT DOCUMENTS

| | | | |
|---|---|---|---|
| 5,873,245 | A | 2/1999 | Kato et al. |
| 2004/0093769 | A1 | 5/2004 | Kondou |
| 2010/0126339 | A1 | 5/2010 | Kobata |

FOREIGN PATENT DOCUMENTS

| | | | |
|---|---|---|---|
| CN | 1157029 | A | 8/1997 |
| CN | 1479840 | A | 3/2004 |

(Continued)

OTHER PUBLICATIONS

The International Search Report for the corresponding international application No. PCT/JP2013/075792, dated Nov. 12, 2013.

(Continued)

*Primary Examiner* — F. Daniel Lopez
(74) *Attorney, Agent, or Firm* — Global IP Counselors, LLP

(57) ABSTRACT

A hydraulic fluid flowpath includes a first flowpath and a second flowpath. The first flowpath connects a first pump port and a first chamber in a hydraulic cylinder. The second flowpath connects a second pump port and a second chamber in the hydraulic cylinder. The hydraulic fluid flowpath forms a closed circuit between a hydraulic pump and the hydraulic cylinder. A bleed-off flowpath bleeds off a portion of the hydraulic fluid from the second flowpath. A control valve connects the second flowpath to the bleed-off flowpath via a throttle when an operation amount of an operating member for lowering a work implement is less than a predetermined operation amount so that a hydraulic pressure in second flowpath is maintained at less than a relief (Continued)

pressure. The predetermined operation amount is less than or equal to the maximum operation amount for lowering the work implement.

19 Claims, 8 Drawing Sheets

(51) Int. Cl.
*F15B 11/08* (2006.01)
*E02F 9/22* (2006.01)

(52) U.S. Cl.
CPC ..... *E02F 9/2235* (2013.01); *E02F 9/2282* (2013.01); *E02F 9/2289* (2013.01); *E02F 9/2292* (2013.01); *E02F 9/2296* (2013.01); *F15B 11/08* (2013.01); *F15B 11/0423* (2013.01); *F15B 2211/20561* (2013.01); *F15B 2211/27* (2013.01); *F15B 2211/7053* (2013.01); *F15B 2211/761* (2013.01); *F15B 2211/785* (2013.01)

(56) References Cited

FOREIGN PATENT DOCUMENTS

| | | | |
|---|---|---|---|
| CN | 101663491 | A | 3/2010 |
| CN | 102305223 | A | 1/2012 |
| JP | 49-125764 | A | 12/1974 |
| JP | 55-149332 | U | 10/1980 |
| JP | 1-280132 | A | 11/1989 |
| JP | 10-331803 | A | 12/1998 |
| JP | 2001-12406 | A | 1/2001 |
| JP | 2003-21104 | A | 1/2003 |

OTHER PUBLICATIONS

Office Action for the corresponding Chinese patent application No. 201380034177.7, dated Dec. 2, 2015.

HYDRAULIC DRIVE SYSTEM

CROSS-REFERENCE TO RELATED APPLICATIONS

This application is a U.S. National stage application of International Application No. PCT/JP2013/075792, filed on Sep. 25, 2013. This U.S. National stage application claims priority under 35 U.S.C. §119(a) to Japanese Patent Application No. 2012-231357, filed in Japan on Oct. 19, 2012, the entire contents of which are hereby incorporated herein by reference.

BACKGROUND

Field of the Invention

The present invention relates to a hydraulic drive system.

Background Information

Machinery, such as hydraulic shovels and wheel loaders, is provided with a work implement that is driven by a hydraulic cylinder. The hydraulic cylinder is supplied with the hydraulic fluid discharged from a hydraulic pump. The hydraulic fluid is supplied to the hydraulic cylinder by way of a hydraulic circuit. For instance, Japanese Laid-Open Patent Application Publication No. 2003-21104 proposes a work implement equipped with a closed hydraulic circuit for supplying hydraulic fluid to the hydraulic cylinder. The closed hydraulic circuit regenerates the positional energy of the work implement. Thus, it is possible to reduce the fuel consumption of a prime mover driving the hydraulic pump.

The above-mentioned closed hydraulic circuit is also provided with a relief valve. The relief valve opens when hydraulic pressure in the closed hydraulic circuit is at or above a predetermined relief pressure. Thereby, the relief valve regulates the increase in hydraulic pressure in the closed hydraulic circuit.

SUMMARY

Only the relief valve regulates the hydraulic pressure in the above-described closed hydraulic circuit. Namely, unlike an open hydraulic circuit in which the hydraulic fluid from the hydraulic cylinder is sent to a hydraulic fluid tank, in the closed hydraulic circuit the hydraulic fluid expelled from the hydraulic cylinder circulates through the closed hydraulic circuit and returns to the hydraulic pump. Consequently, the hydraulic pressure in the closed hydraulic circuit tends to increase up to the relief pressure.

Therefore, the hydraulic pressure in the closed hydraulic circuit tends to rise rapidly even when an operator operates a control in a manner to slowly lower a work implement. In this case, it can be difficult for the operator to adjust the work implement to a desired height because of the large accelerative force of the work implement.

For example, in some cases, a hydraulic shovel is operated such that the upper revolving unit is positioned at approximately 90° relative to the crawler tracks while the bottom of the bucket of the work implement presses against the ground to raise one of the crawler tracks from the ground. With the vehicle set in this orientation, it is possible to remove mud adhered to the crawler track by spraying high-pressure water and rotating the raised crawler track. At this time the operator sets an arm positioned approximately 90° relative to the ground and the bottom of the bucket pushing against the ground. The operator then slowly sets the boom lowered to raise the crawler track from the ground.

However, as above described, when the hydraulic pressure in the closed hydraulic circuit rises rapidly, the crawler track rises suddenly from the ground. The operator can find it difficult to adjust the position of the crawler track to a desired height when the crawler track rises suddenly.

The present invention aims to provide a hydraulic drive system that facilitates adjusting the position of a work implement to a desired height.

A hydraulic drive system according to a first aspect of the present invention includes a hydraulic pump, a drive source, a work implement, a hydraulic cylinder, a hydraulic fluid flowpath, a relief valve, an operating member, a bleed-off flowpath, and a control valve. The hydraulic pump includes a first pump port and a second pump port. The hydraulic pump is switchable between a first state and a second state. In the first state, the hydraulic pump takes in hydraulic fluid from the second pump port and discharges the hydraulic fluid from the first pump port. In the second state, the hydraulic pump takes in the hydraulic fluid from the first pump port and discharges the hydraulic fluid from the second pump port. The drive source drives the hydraulic pump. The hydraulic fluid discharged from the hydraulic pump drives the hydraulic cylinder. The hydraulic cylinder includes a first chamber and a second chamber. The hydraulic cylinder expels the hydraulic fluid from the first chamber, and supplies the hydraulic fluid to the second chamber to lower the work implement. The hydraulic cylinder supplies the hydraulic fluid to the first chamber, and expels the hydraulic fluid to the second chamber to raise the work implement. The hydraulic fluid flowpath includes a first flowpath and a second flowpath. The first flowpath connects the first pump port and the first chamber. The second flowpath connects the second pump port and the second chamber. The hydraulic fluid flowpath forms a closed circuit between the hydraulic pump and the hydraulic cylinder. The relief valve opens when the hydraulic pressure in the hydraulic fluid flowpath is at or above the relief pressure. The operating member is for operating the work implement. The bleed-off flowpath is for bleeding off a portion of the hydraulic fluid from the second flowpath. When an operation amount of the operating member used for lowering the work implement is smaller than a predetermined operation amount, the control valve connects the second flowpath to the bleed-off flowpath via throttle to maintain the hydraulic pressure in the second flowpath at less than the relief pressure. The predetermined operation amount is less than or equal to a maximum operation amount of the operating member for lowering the work implement.

A work vehicle according to a second aspect of the present invention is the hydraulic drive system according to the first aspect of the present invention wherein the control valve closes an opening between the second flowpath and the bleed-off flowpath when the operation amount of the operating member is greater than or equal to the predetermined operation amount.

A work vehicle according to a third aspect of the present invention is the hydraulic drive system according to the first or the second aspect of the present invention further comprising a pump controller. The pump controller controls the capacity of the hydraulic pump. The hydraulic pump includes a first hydraulic pump and a second hydraulic pump. The pump controller reduces the capacity directed to the second hydraulic pump by a predetermined capacity when the operation amount of the operating member is smaller than a predetermined operation amount. The predetermined capacity is the hydraulic pump capacity corresponding to the flow rate of the hydraulic fluid diverted from the second flowpath to the bleed-off flowpath.

A work vehicle according to a fourth aspect of the present invention is the hydraulic drive system according to any one of the first through third aspects of the present inventions wherein the control valve adjusts the opening area between the second flowpath of the bleed-off flowpath such that the hydraulic pressure in the second flowpath increases in accordance with an increase in the operation amount of the operating member when the operation amount of the operating member is smaller than the predetermined operation amount.

A work vehicle according to a fifth aspect of the present invention is the hydraulic drive system according to any one of the first through fourth aspects of the present invention further comprising a charge circuit. The charge circuit is a hydraulic circuit that supplements the hydraulic fluid in the hydraulic fluid flowpath. The bleed-off flowpath is connected to the charge circuit.

A work vehicle according to a sixth aspect of the present invention is the hydraulic drive system according to any one of the first through fourth aspects of the present invention wherein the bleed-off flowpath is connected to the first flowpath.

A work vehicle according to a seventh aspect of the present invention is the hydraulic drive system according to any one of the first through fourth aspects of the present invention further comprising a hydraulic fluid tank. The hydraulic fluid tank stores the hydraulic fluid. The bleed-off flowpath is connected to the hydraulic fluid tank.

In the hydraulic drive system according to the first aspect of the present invention, the second flowpath is connected to the bleed-off flowpath via a throttle when the operation amount of the operating member for lowering the work implement is less than a predetermined operation amount. Thus, a portion of the hydraulic fluid in the second flowpath is bled off into the bleed-off flowpath, and the hydraulic pressure in the second flowpath is maintained at less than the relief pressure. Therefore, the acceleration force to lower the work implement can be suppressed. This facilitates the operator's adjusting the position of the work implement to a desired height.

In the hydraulic drive system according to the second aspect of the present invention, the opening between the second flowpath and the bleed-off flowpath is closed when the operation amount of the operation member is greater than or equal to a predetermined operation amount. Therefore, the work implement can be lowered quickly when the operation amount of the operation member is greater than or equal to a predetermined operation amount. Thus, it is possible to improve the work efficiency of the work implement.

In the hydraulic drive system according to the third aspect of the present invention, the charge flow rate into the hydraulic fluid flowpath can be reduced. Thus, it is possible to improve the fuel consumption of the drive source.

In the hydraulic drive system according to the fourth aspect of the present invention, the hydraulic pressure in the second flowpath increases in accordance with the increase in the operation amount of the operation member even when the operation amount of the operation member is smaller than the predetermined operation amount. Thus, it is possible to adjust the operation speed of the work implement using the operation member.

In the hydraulic drive system according to the fifth aspect of the present invention, the hydraulic fluid bled off from the second flowpath is returned to the hydraulic pump via the charge circuit. Consequently, the hydraulic fluid bled off can be reused within the hydraulic pump.

In the hydraulic drive system according to the sixth aspect of the present invention the hydraulic fluid is sent from the second flowpath through the bleed-off flowpath to the first flowpath. Consequently, the hydraulic fluid bled off from the second flowpath is returned to the hydraulic pump via the first flowpath.

In the hydraulic drive system according to the seventh aspect of the present invention the hydraulic fluid is sent from the second flowpath through the bleed-off flowpath to the hydraulic fluid tank. Consequently, the hydraulic fluid bled off from the second flowpath is sent to the hydraulic pump.

DETAILED DESCRIPTION OF EXEMPLARY EMBODIMENTS

A hydraulic drive system according to exemplary embodiments of the present invention is described below with reference to the drawings.

First Exemplary Embodiment

Figure 1:
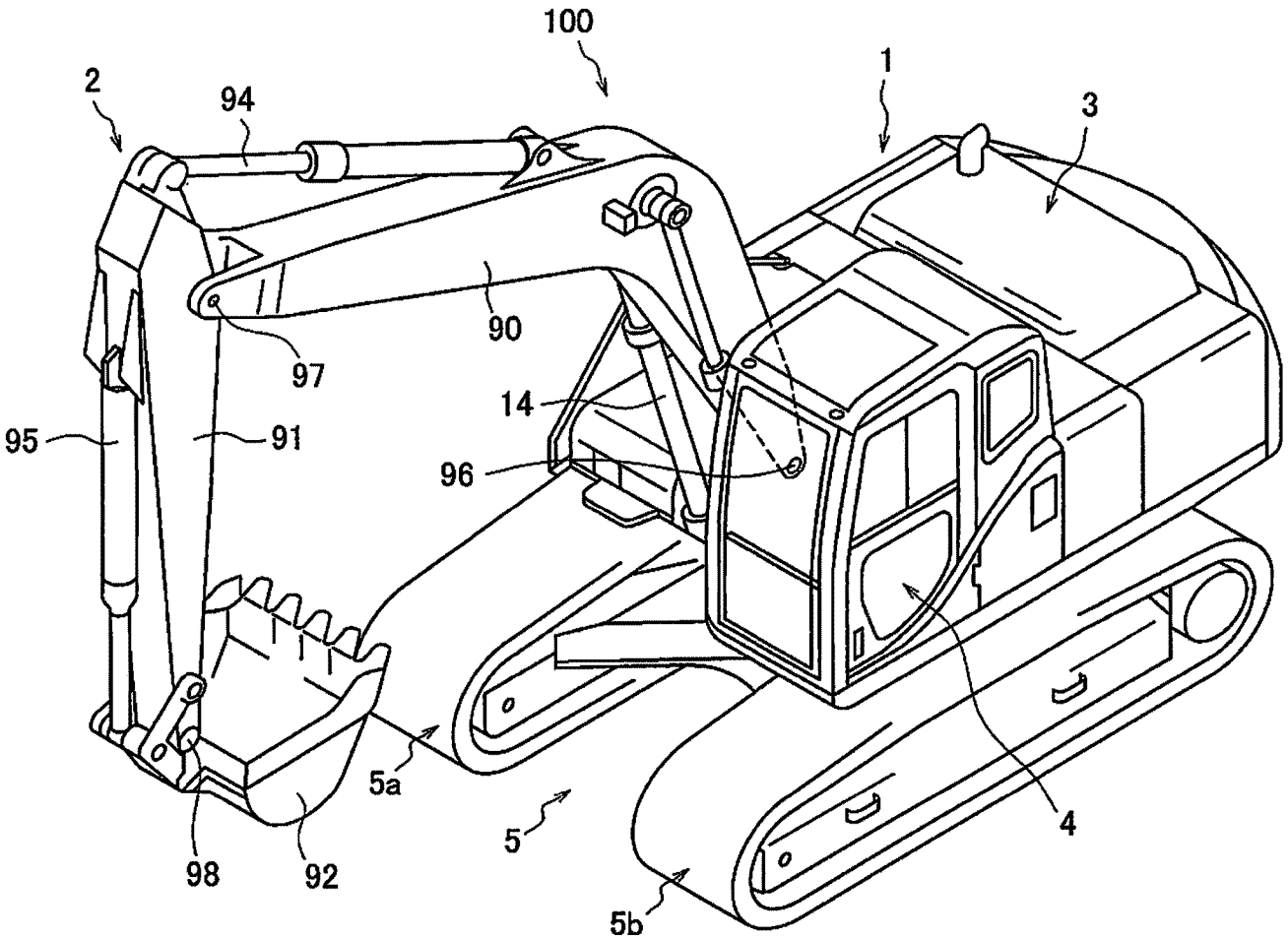
FIG. 1 illustrates an outer appearance of a hydraulic shovel containing a hydraulic drive system according to a first exemplary embodiment of the present invention.

FIG. 1 is a perspective view of a hydraulic shovel 100 containing the hydraulic drive system according to a first exemplary embodiment of the present invention. The hydraulic shovel 100 includes a vehicle body 1 and a work implement 2. The vehicle body 1 includes an upper revolving unit 3, a cab 4, and an undercarriage 5. The upper revolving unit 3 is mounted on the undercarriage 5. The upper revolving unit 3 is provided on the undercarriage 5 to be rotatable with respect to the undercarriage 5. The upper revolving unit 3 houses apparatus, such as an engine and a hydraulic pump, which are described hereinafter. The cab 4 is located at the front of the upper revolving unit 3. An operating device, which is described hereinafter, is arranged within the cab 4. The undercarriage 5 includes crawler tracks 5*a*, 5*b*. The hydraulic shovel 100 travels via the rotation of the crawler tracks 5*a*, 5*b*.

The work implement 2 is attached to the front of the vehicle body 1. The work implement 2 includes a boom 90, and arm 91, and a bucket 92. The base end of the boom 90 is swingably attached to the upper revolving unit 3 via a boom pin 96. The base end of the arm 91 is swingably attached to the tip end of the boom 90 via an arm pin 97. The bucket 92 is swingably attached to the tip end of the arm 91 via a bucket pin 98. A hydraulic cylinder 14 drives the boom 90. A hydraulic cylinder 94 drives the arm 91. A hydraulic cylinder 95 drives the bucket 92.

Figure 2:
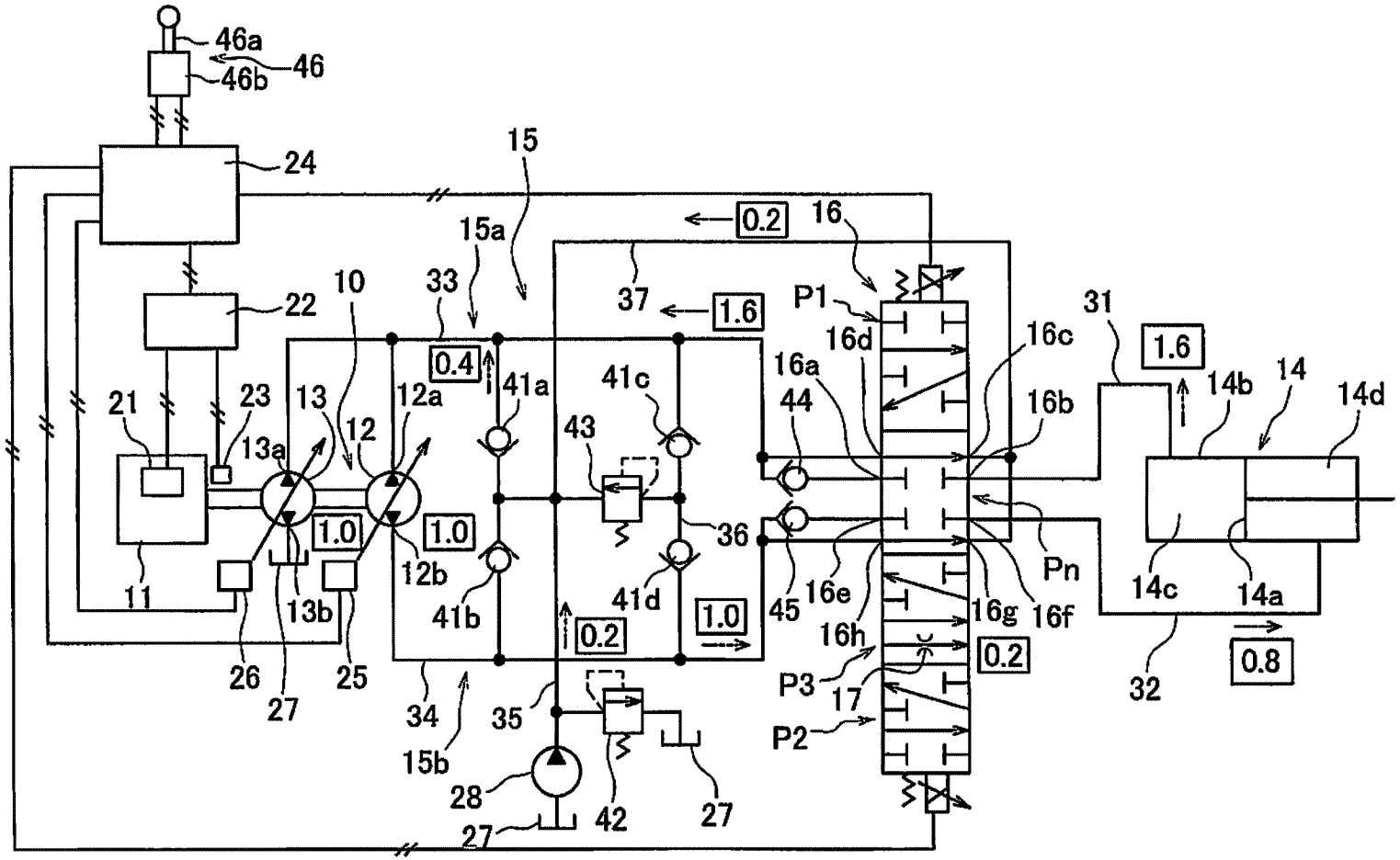
FIG. 2 is a block diagram of a configuration of a hydraulic drive system according to the first exemplary embodiment.

FIG. 2 is a block diagram illustrating a configuration of the hydraulic drive system. The hydraulic drive system is a system for driving the boom 90. The hydraulic drive system includes an engine 11, a main pump 10, a hydraulic cylinder 14, a hydraulic fluid flowpath 15, a control valve 16, and a pump controller 24.

The engine 11 drives the main pump 10. The engine 11 is one example of a drive source in the present invention. The engine 11 may be, for example, a diesel engine. The output of the engine 11 is controlled by adjusting the amount of fuel injected from a fuel injection device 21. An engine controller 22 controls the fuel injection device 21 to thereby control the adjustment of the fuel injection amount. Moreover, the actual rotation speed of the engine 11 may be detected via a rotation speed sensor 23, and a detection signal from the rotation speed sensor 23 may be input into the engine controller 22 and the pump controller 24 respectively.

The main pump 10 includes a first hydraulic pump 12 and a second hydraulic pump 13. The first hydraulic pump 12 and the second hydraulic pump 13 are driven by the engine 11 and discharge hydraulic fluid. The hydraulic fluid discharged from the main pump 10 is supplied to the hydraulic cylinder 14 via the control valve 16.

The first hydraulic pump 12 is a variable capacity hydraulic pump. The capacity of the first hydraulic pump 12 is controlled by controlling a tilt angle within the first hydraulic pump 12. The tilt angle within the first hydraulic pump 12 is controlled by a first pump flow control section 25. The first pump flow control section 25 controls the tilt angle within the first hydraulic pump 12 on the basis of a command signal received from the pump controller 24. Thereby the first pump flow control section 25 controls the flow rate of the hydraulic fluid discharged from the first hydraulic pump 12.

The first hydraulic pump 12 is a bidirectional discharge type hydraulic pump. More specifically, the first hydraulic pump 12 includes a first pump port 12*a* and a second pump port 12*b*. The first hydraulic pump 12 may be switched between a first discharge state and a second discharge state. In the first discharge state, the first hydraulic pump 12 takes in hydraulic fluid from the second pump port 12*b* and discharges hydraulic fluid from the first pump port 12*a*. In the second discharge state, the first hydraulic pump 12 takes in hydraulic fluid from the first pump port 12*a* and discharges hydraulic fluid from the second pump port 12*b*.

The second hydraulic pump 13 is a variable capacity hydraulic pump. The capacity of the second hydraulic pump 13 is controlled by controlling a tilt angle within the second hydraulic pump 13. The tilt angle within the second hydraulic pump 13 may be controlled by a second pump flow control section 26. The second pump flow control section 26 controls the tilt angle within the second hydraulic pump 13 on the basis of a command signal received from the pump controller 24. Thereby, the second pump flow control section 26 controls the flow rate of the hydraulic fluid discharged from the second hydraulic pump 13.

The second hydraulic pump 13 is a bidirectional discharge type hydraulic pump. More specifically, the second hydraulic pump 13 includes a first pump port 13*a* and a second pump port 13*b*. The second hydraulic pump 13 may be switched between a first discharge state and a second discharge state, similarly to the first hydraulic pump 12. In the first discharge state, the second hydraulic pump 13 takes in hydraulic fluid from the second pump port 13*b* and discharges hydraulic fluid from the first pump port 13*a*. In the second discharge state, the second hydraulic pump 13 takes in hydraulic fluid from the first pump port 13*a* and discharges hydraulic fluid from the second pump port 13*b*.

The hydraulic fluid discharged from the first hydraulic pump 12 and the second hydraulic pump 13 drives the hydraulic cylinder 14. As described above, the hydraulic cylinder 14 drives the boom 90. When the hydraulic cylinder 14 expands, the tip end of the boom 90 ascends. That is, the work implement 2 ascends. When the hydraulic cylinder 14 contracts, the tip end of the boom 90 descends. That is, the work implement 2 descends. Further, in some attachment condition of the hydraulic cylinder 14, the extension of the hydraulic cylinder 14 may cause the work implement 2 to descend. In this case, the work implement 2 ascends when the hydraulic cylinder 14 contracts. The hydraulic cylinder 14 includes a cylinder rod 14*a* and a cylinder tube 14*b*. The cylinder rod 14*a* divides the inside of the cylinder tube 14*b* into a first chamber 14*c* and a second chamber 14*d*.

The hydraulic cylinder 14 expands and contracts due to the supplying or expelling hydraulic fluid to or from the first chamber 14*c* and the second chamber 14*d*. More specifically, the hydraulic cylinder 14 expands with the hydraulic fluid supplied to the first chamber 14*c* and the hydraulic fluid expelled from the second chamber 14*d*. The hydraulic cylinder 14 contracts with the hydraulic fluid supplied to the second chamber 14*d* and the hydraulic fluid expelled from the first chamber 14*c*. The pressure receiving area of the cylinder rod 14*a* in the first chamber 14*c* is larger than the pressure receiving area of the cylinder rod 14*a* in the second chamber 14*d*. Accordingly, when the hydraulic cylinder 14 expands, a larger amount of hydraulic fluid is supplied to the first chamber 14*c* than the amount of hydraulic fluid expelled from the second chamber 14*d*. Furthermore, when the hydraulic cylinder 14 contracts, a larger amount of hydraulic fluid is expelled from the first chamber 14*c* than the amount of hydraulic fluid supplied to the second chamber 14*d*.

The hydraulic fluid flowpath 15 connects the first hydraulic pump 12, the second hydraulic pump 13, and the hydraulic cylinder 14. The hydraulic fluid flowpath 15 includes a first flowpath 15*a* and a second flowpath 15*b*. The first flowpath 15*a* connects the first pump port 12*a* of the first hydraulic pump 12, and the first chamber 14*c* in the hydraulic cylinder 14. The first pump port 13*a* in the second hydraulic pump 13 is connected to the first flowpath 15*a*. The second flowpath 15*b* connects the second pump port 12*b* in the first hydraulic pump 12 and the second chamber 14*d* in the hydraulic cylinder 14. The second pump port 13*b* in the second hydraulic pump 13 is connected to the hydraulic fluid tank 27.

The first flowpath 15*a* includes a first cylinder flowpath 31 and a first pump flowpath 33. The second flowpath 15*b* includes a second cylinder flowpath 32 and a second pump flowpath 34. The first cylinder flowpath 31 connects to the first chamber 14*c* in the hydraulic cylinder 14. The second cylinder flowpath 32 connects to the second chamber 14*d* in the hydraulic cylinder 14. The first pump flowpath 33 supplies hydraulic fluid to the first chamber 14*c* in the hydraulic cylinder 14 via the first cylinder flowpath 31. Alternatively, the first pump flowpath 33 collects hydraulic fluid from the first chamber 14*c* in the hydraulic cylinder 14 via the first cylinder flowpath 31.

The first pump flowpath 33 connects to the first pump port 12*a* in the first hydraulic pump 12. Additionally the first pump flowpath 33 connects to the first pump port 13*a* in the second hydraulic pump 13. Accordingly, the first pump flowpath 33 is supplied with hydraulic fluid from both the first hydraulic pump 12 and the second hydraulic pump 13. The second pump flowpath 34 supplies hydraulic fluid to the second chamber 14*d* in the hydraulic cylinder 14 via the second cylinder flowpath 32. Alternatively the second pump flowpath 34 collects hydraulic fluid from the second chamber 14*d* in the hydraulic cylinder 14 via the second cylinder flowpath 32.

The second pump flowpath 34 connects to the second pump port 12*b* in the first hydraulic pump 12. The second pump port 13*b* of the second hydraulic pump 13 is connected to the hydraulic fluid tank 27. Accordingly, the second pump flowpath 34 is supplied with hydraulic fluid from the first hydraulic pump 12. Thus, as described above, the hydraulic fluid flowpath 15, including the first flowpath 15*a* and the second flowpath 15*b*, configures a closed circuit between the main pump 10 and the hydraulic cylinder 14.

The hydraulic drive system is further provided with a charge pump 28. The charge pump 28 is a hydraulic pump for supplementing the hydraulic fluid in the first flowpath 15*a* or the second flowpath 15*b*. Driven by the engine 11, the charge pump 28 discharges the hydraulic fluid. The charge pump 28 is a fixed capacity hydraulic pump. The hydraulic fluid flowpath 15 further includes a charge circuit 35. The charge circuit 35 connects to the first pump flowpath 33 via a check valve 41*a*. The check valve 41*a* opens when the hydraulic pressure in the first pump flowpath 33 is less than the hydraulic pressure in the charge circuit 35.

The charge circuit 35 is connected to the second pump flowpath 34 via a check valve 41*b*. The check valve 41*b* opens when the hydraulic pressure in the second pump flowpath 34 is less than the hydraulic pressure in the charge circuit 35. Additionally, the charge circuit 35 is connected to the hydraulic fluid tank 27 via a relief valve 42. The relief valve 42 maintains the hydraulic pressure in the charge circuit 35 at a predetermined charge pressure. When the hydraulic pressure in the first pump flowpath 33 or the second pump flowpath 34 falls below the hydraulic pressure in the charge circuit 35, the hydraulic fluid from the charge pump 28 is supplied to the first pump flowpath 33 or the second pump flowpath 34 via the charge circuit 35. Thus, the hydraulic pressure in the first pump flowpath 33 and the second pump flowpath 34 may be maintained at a predetermined value or greater.

The hydraulic fluid flowpath 15 further includes a relief flowpath 36. The relief flowpath 36 connects to the first pump flowpath 33 via a check valve 41*c*. The check valve 41*c* opens when the hydraulic pressure in the first pump flowpath 33 is greater than the hydraulic pressure in the relief flowpath 36. The relief flowpath 36 is connected to the second pump flowpath 34 via a check valve 41*d*. The check valve 41*d* opens when the hydraulic pressure in the second pump flowpath 34 is greater than the hydraulic pressure in the relief flowpath 36. The relief flowpath 36 is connected to the charge circuit 35 via a relief valve 43. The relief valve 43 maintains the hydraulic pressure in the relief flowpath 36 at a predetermined relief pressure or less. Therefore, the hydraulic pressure in the first pump flowpath 33 and the second pump flowpath 34 may be maintained at a predetermined relief pressure or less.

The hydraulic drive system includes a bleed-off flowpath 37. The bleed-off flowpath 37 connects to the charge circuit 35. A portion of the hydraulic fluid in the second flowpath 15*b* flows into the bleed-off flowpath 37 when the work implement 2 is descending. The control of the descent of the work implement 2 is described later in detail.

The control valve 16 is an electromagnetic control valve controlled on the basis of a command signal from the pump controller 24. The control valve 16 controls the flow rate of the hydraulic fluid supplied to the hydraulic cylinder 14 on the basis of a command signal from the pump controller 24. The control valve 16 is arranged between the main pump 10 and the hydraulic cylinder 14 in the hydraulic fluid flowpath 15. When the hydraulic cylinder 14 expands, the control valve 16 controls the flow rate of the hydraulic fluid supplied from the first pump flowpath 33 to the hydraulic cylinder 14, and the flow rate of the hydraulic fluid supplied from the first pump flowpath 33 to the bleed-off flowpath 37. Additionally, when the hydraulic cylinder 14 contracts, the control valve 16 controls the flow rate of the hydraulic fluid supplied from the second pump flowpath 34 to the hydraulic cylinder 14, and the flow rate of the hydraulic fluid supplied from the second pump flowpath 34 to the bleed-off flowpath 37.

The control valve 16 includes a first-pump port 16*a*, a first-cylinder port 16*b*, a first bleed-off port 16*c*, and a first bypass port 16*d*. The first-pump port 16*a* is connected to the first pump flowpath 33 via a first direction control section 44. The first direction control section 44 is a check valve that regulates the flow of the hydraulic fluid in one direction. The first-cylinder port 16*b* is connected to the first cylinder flowpath 31. The first bleed-off port 16*c* is connected to the bleed-off flowpath 37. The aforementioned first direction control section 44 allows the hydraulic fluid to flow from the first pump flowpath 33 to the first cylinder flowpath 31, and prevents the hydraulic fluid from flowing from the first cylinder flowpath 31 to the first pump flowpath 33 when the control valve 16 supplies the hydraulic fluid from the first pump flowpath 33 to the first cylinder flowpath 31.

The control valve 16 further includes a second-pump port 16*e*, a second-cylinder port 16*f*, a second bleed-off port 16*g*, and a second bypass port 16*h*. The second-pump port 16*e* is connected to the second pump flowpath 34 via a second direction control section 45. The second direction control section 45 is a check valve that regulates the flow of the hydraulic fluid in one direction. The second-cylinder port 16*f* is connected to the second cylinder flowpath 32. The second bleed-off port 16*g* is connected to the bleed-off flowpath 37.

The aforementioned second direction control section 45 allows the hydraulic fluid to flow from the second pump flowpath 34 to the second cylinder flowpath 32, and prevents the hydraulic fluid from flowing from the second cylinder flowpath 32 to the second pump flowpath 34 when the control valve 16 supplies the hydraulic fluid from the second pump flowpath 34 to the second cylinder flowpath 32.

The control valve 16 can be switched between a first position state P1, a second position state P2, a neutral position state Pn, and a third position state P3. In the first position state P1, the control valve 16 links the first-pump port 16*a* and the first-cylinder port 16*b*, and links the second-cylinder port 16*f* and the second bypass port 16*h*. Accordingly, in the first position state P1, the control valve 16 connects the first pump flowpath 33 to the first cylinder flowpath 31 via the first direction control section 44, and connects the second cylinder flowpath 32 to the second pump flowpath 34 bypassing the second direction control section 45. Moreover, when the control valve 16 is in the first position state P1 the first bypass port 16*d*, the first bleed-off port 16*c*, the second-pump port 16*e*, and the second bleed-off port 16*g* are insulated from all the other ports.

When the hydraulic cylinder 14 expands, the first hydraulic pump 12 and the second hydraulic pump 13 are driven in a first discharge state, and the control valve 16 is set to the first position state P1. Thereby the hydraulic fluid discharged from the first pump port 12*a* of the first hydraulic pump 12, and the first pump port 13*a* of the second hydraulic pump 13 passes through the first pump flowpath 33, the first direction control section 44, and the first cylinder flowpath 31, and is supplied to the first chamber 14*c* of the hydraulic cylinder 14. Additionally, the hydraulic fluid in the second chamber 14*d* of the hydraulic cylinder 14 passes through the second cylinder flowpath 32 and the second pump flowpath 34 and is collected at the second pump port 12*b* of the first hydraulic pump 12. As a result, the hydraulic cylinder 14 expands.

In the second position state P2, the control valve 16 links the second-pump port 16*e* and the second-cylinder port 16*f*, and links the first-cylinder port 16*b* and the first bypass port 16*d*. Accordingly, in the second position state P2, the control valve 16 connects the first cylinder flowpath 31 to the first pump flowpath 33 bypassing the first direction control section 44, and connects the second pump flowpath 34 to the second cylinder flowpath 32 via the second direction control section 45. Moreover, when the control valve 16 is in the second position state P2, the first-pump port 16*a*, the first bleed-off port 16*c*, the second bypass port 16*h*, and the second bleed-off port 16*g* are insulated from all the other ports.

When the hydraulic cylinder 14 contracts, the first hydraulic pump 12 and the second hydraulic pump 13 are driven in a second discharge state, and the control valve 16 is set to the second position state P2. Thereby, the hydraulic fluid discharged from the second pump port 12*b* of the first hydraulic pump 12 passes through the second pump flowpath 34, the second direction control section 45, and the second cylinder flowpath 32 and is supplied to the second chamber 14*d* of the hydraulic cylinder 14. Additionally, the hydraulic fluid in the first chamber 14*c* of the hydraulic cylinder 14 passes through the first cylinder flowpath 31 and the first pump flowpath 33 and is collected at the first pump port 12*a* of the first hydraulic pump 12 and the first pump port 13*a* of the second hydraulic pump 13. As a result, the hydraulic cylinder 14 contracts.

In the neutral position state Pn, the control valve 16 links the first bypass port 16*d* and the first bleed-off port 16*c*, and links the second bypass port 16*h* and the second bleed-off port 16*g*. Accordingly, in the neutral position state Pn, the control valve 16 connects the first pump flowpath 33 to the bleed-off flowpath 37 bypassing the first direction control section 44, and connects the second pump flowpath 34 to the bleed-off flowpath 37 bypassing the second direction control section 45. Moreover, when the control valve 16 is in the neutral position state Pn, the first-pump port 16*a*, the first-cylinder port 16*b*, the second-pump port 16*e*, and the second-cylinder port 16*f* are insulated from all the other ports.

In the third position state P3, the control valve 16 links the second-pump port 16*e* and the second-cylinder port 16*f*, and links the first-cylinder port 16*b* and the first bypass port 16*d*. Accordingly, in the third position state P3, the control valve 16 connects the first cylinder flowpath 31 to the first pump flowpath 33 bypassing the first direction control section 44 and connects the second pump flowpath 34 to the second cylinder flowpath 32 via the second direction control section 45. Moreover, in the third position state P3, the control valve 16 links the second bypass port 16*h* and the second bleed-off port 16*g* via a throttle 17. Accordingly, in the third position state P3, the control valve 16 connects the second pump flowpath 34 to the bleed-off flowpath 37 via the throttle 17.

Consequently, the bleed-off flowpath 37 is connected to the second flowpath 15*b* to branch off from the second flowpath 15*b*. When the control valve 16 is in the third position state P3, the first-pump port 16*a*, and the first bleed-off port 16*c* are insulated from all the other ports.

The control valve 16 may be set to any suitable position state between the first position state P1 and the neutral position state Pn. Consequently, the control valve 16 can control the flow rate of the hydraulic fluid supplied from the first pump flowpath 33 to the first cylinder flowpath 31 via the first direction control section 44, and the flow rate of the hydraulic fluid supplied from the first pump flowpath 33 to the bleed-off flowpath 37. That is, the control valve 16 controls the flow rate of the hydraulic fluid supplied from the first hydraulic pump 12 and the second hydraulic pump 13 to the first chamber 14*c* in the hydraulic cylinder 14, and the flow rate of the hydraulic fluid supplied from the first hydraulic pump 12 and the second hydraulic pump 13 to the bleed-off flowpath 37.

The control valve 16 may be set to any suitable position state between the second position state P2 and the neutral position state Pn. Consequently, the control valve 16 can control the flow rate of the hydraulic fluid supplied from the second pump flowpath 34 to the second cylinder flowpath 32 via the second direction control section 45, and the flow rate of the hydraulic fluid supplied from the second pump flowpath 34 to the bleed-off flowpath 37. That is, the control valve 16 controls the flow rate of the hydraulic fluid supplied from the first hydraulic pump 12 to the second chamber 14*d* in the hydraulic cylinder 14, and the flow rate of the hydraulic fluid supplied from the first hydraulic pump 12 to the bleed-off flowpath 37.

The control valve 16 may be set to any suitable position state between the second position state P2 and the third position state P3. Therefore, the control valve 16 can control the flow rate of the hydraulic fluid bled off from the second pump flowpath 34 into the bleed-off flowpath 37.

The hydraulic drive system further includes an operating device 46. The operating device 46 includes an operating member 46*a*, and an operation detector 46*b*. The operating member 46*a* is a member for operating the hydraulic cylinder 14. For example, the operating member 46*a* may be a boom operation lever. The operating member 46*a* can be operated from a neutral position in one of the two following directions: a direction causing the hydraulic cylinder 14 to expand, and a direction causing the hydraulic cylinder 14 to contract.

The operation detector 46*b* detects an operation amount of the operating member 46*a* (referred to as a "boom operation amount") and the operation direction. The operation detector 46*b* may be a sensor that detects the position of the operating member 46*a*. When the operating member 46*a* is in a neutral position, the boom operation amount is zero. A detection signal indicating the boom operation amount and the operation direction may be input from the operation detector 46*b* to the pump controller 24. The pump controller 24 computes a target flow rate for the hydraulic fluid supplied of the hydraulic cylinder 14 in accordance with the boom operation amount.

The engine controller 22 controls a fuel injection device 21 to control the output of the engine 11. In the engine controller 22, a mapping of engine output torque characteristics determined on the basis of set target engine speeds and work modes is stored. The engine output torque characteristics represents a relationship between the output torque and the rotation speed of the engine 11. The engine controller 22 controls the output of the engine 11 on the basis of the engine output torque characteristics.

The pump controller 24 uses the control valve 16 to control the flow rate of the hydraulic fluid supplied to the hydraulic cylinder 14. Additionally, the pump controller 24 controls the flow rate of the hydraulic fluid supplied to the hydraulic cylinder 14 using the first pump flow control section 25 and a second pump flow control section 26. The pump controller 24 is one example of the pump control section in the present invention. The more minute flow rate may be controlled using the control valve 16 than that is controlled with the first pump flow control section 25 and the second pump flow control section 26.

For instance, the pump controller 24 may control the flow rate using of the control valve 16 (referred to below as "low-speed control") when the operation amount of the operating member 46*a* is at a predetermined value or less. The pump controller 24 may control the flow rate using the first pump flow control section 25 and the second pump flow control section 26 (referred to below as "normal control") when the operation amount of the operating member 46*a* is greater than the predetermined value.

During normal control, the pump controller 24 controls the capacity directed to the first hydraulic pump 12 and the second hydraulic pump 13 to thereby control the suction torques in the first hydraulic pump 12 and in the second hydraulic pump 13 on the basis of pump suction torque characteristics. The pump suction torque characteristics represent the relationship between the pump suction torque and the engine rotation speed. The pump suction torque characteristics may be preliminary set on the basis of a work mode and an operation mode, and stored in the pump controller 24.

During low-speed control, the pump controller 24 controls the control valve 16 to maintain the capacity of the first hydraulic pump 12 and the second hydraulic pump 13, and thereby controls the flow rate of the hydraulic fluid supplied to the hydraulic cylinder 14.

The bleed-off control is described next. The bleed-off control sends a portion of the hydraulic fluid in the second flowpath 15*b* is sent to the bleed-off flowpath 37 when the hydraulic cylinder 14 is contracting, that is, when the work implement 2 is descending. More specifically, the pump controller 24 controls the control valve 16 in accordance with the boom-lowering operation amount on the basis of the bleed-off opening area information L2 illustrated in FIG. 3. The boom-lowering operation amount corresponds to the boom operation amount when the work implement 2 is caused to descend.

Figure 3:
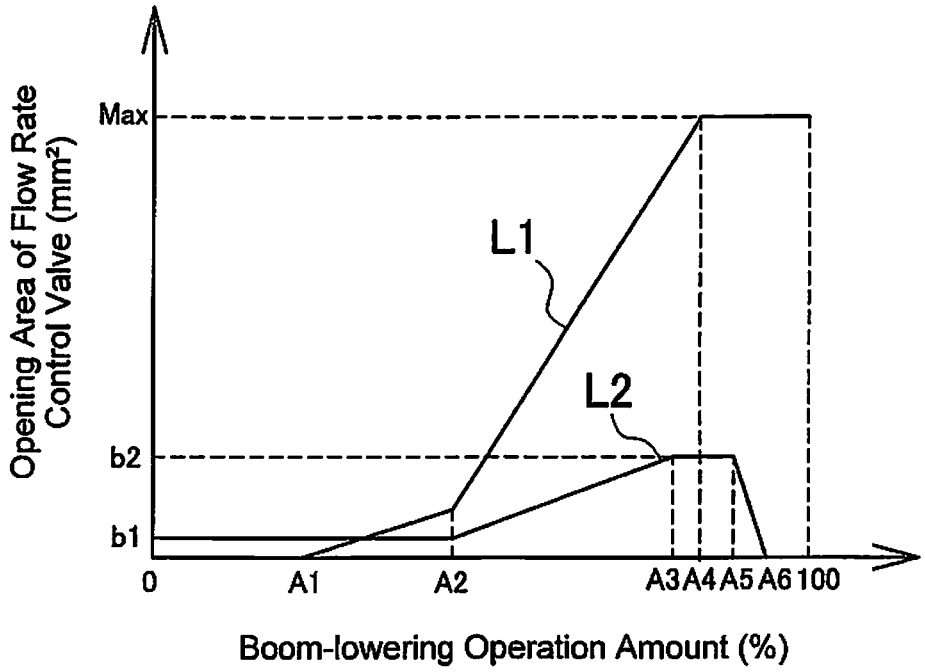
FIG. 3 illustrates boom-lowering opening area information, and bleed-off opening area information.

FIG. 3 illustrates a boom-lowering opening area information L1, and bleed-off opening area information L2. The boom-lowering opening area information L1 defines the relationship between the boom-lowering operation amount and the boom-lowering opening area. The boom-lowering opening area is the area of the opening between the second pump flowpath 34 and the second cylinder flowpath 32 in the control valve 16. In FIG. 3, the boom-lowering operation amount is represented as a percentage of the maximum operation amount of the operating member 46*a*, where the maximum operation amount is 100%.

According to the boom-lowering opening area information L1, the boom-lowering opening area increases in accordance with an increase in the boom-lowering operation amount when the boom-lowering operation amount is A1 or greater and less than A2. The aforementioned low-speed control is performed when the boom-lowering operation amount is A1 or greater and less than A2. The aforementioned normal control is carried out when the boom-lowering operation amount is greater than or equal to A2. More specifically, the boom-lowering opening area increases more rapidly in accordance with the increase of the boom-lowering operation amount when the boom-lowering operation amount is A2 or greater and less than A4 than during the low-speed control. Further, when the boom-lowering operation amount is greater than or equal to A4, the boom-lowering opening area is the maximum value Max. That is, the opening area in the control valve 16 between the second pump flowpath 34 and the second cylinder flowpath 32 is maximum.

The bleed-off opening area information L2 defines the relationship between the boom-lowering operation amount and the bleed-off opening area during bleed-off control. The bleed-off opening area is an opening area between the second pump flowpath 34 and the bleed-off flowpath 37 in the control valve 16. The bleed-off opening area is controlled by setting the control valve 16 between the third position state P3 and the second position state P2.

When the boom-lowering operation amount is a predetermined operation amount A2 or greater and less than a predetermined operation amount A3, the bleed-off opening area increases in accordance with an increase in the boom-lowering operation amount. When the boom-lowering operation amount is the predetermined amount A3 or greater and less than a predetermined operation amount A5, the bleed-off opening area remains constant at b2. When the boom-lowering operation amount is the predetermined operation amount A5 or greater and less than a predetermined operation amount A6, the bleed-off opening area decreases in accordance with an increase in the boom-lowering operation amount. When the boom-lowering operation amount is at or greater than the predetermined operation amount A6, the bleed-off opening area is zero. That is, when the boom-lowering operation amount is at or greater than the predetermined operation amount A6, the opening between the second pump flowpath 34 and the bleed-off flowpath 37 is closed.

Figure 4:
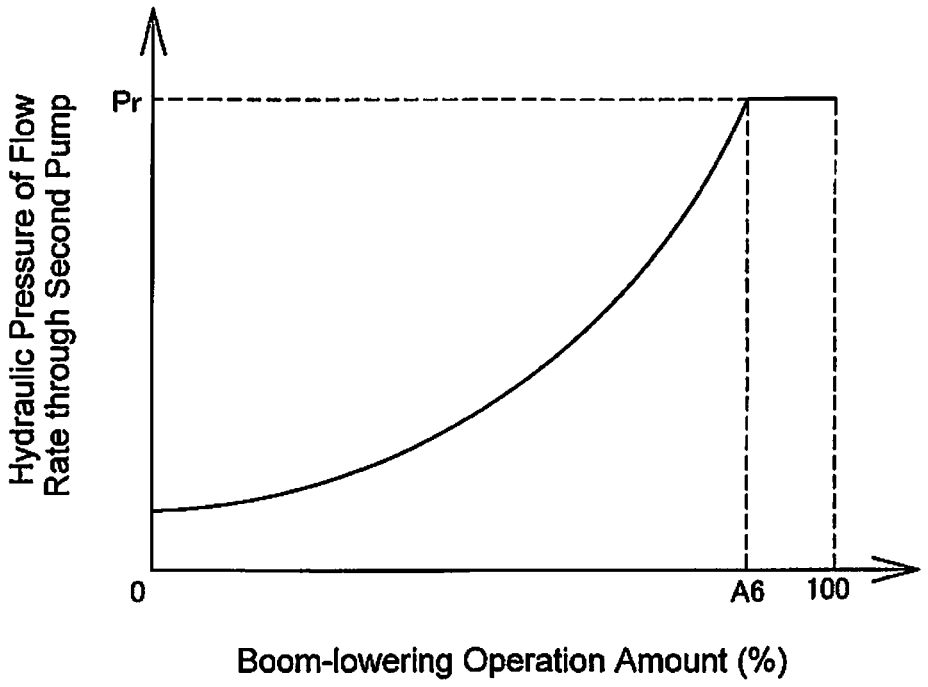
FIG. 4 illustrates a relationship between a boom-lowering operation amount, and the hydraulic pressure in a second pump flowpath.

When the boom-lowering operation amount is less than the predetermined operation amount A6, a portion of the hydraulic fluid in the second pump flowpath 34 flows into the bleed-off flowpath 37. Consequently, an increase in the hydraulic pressure in the second pump flowpath 34 is suppressed. FIG. 4 illustrates the relationship between the boom-lowering operation amount and the hydraulic pressure in the second pump flowpath 34. As illustrated in FIG. 4, when the boom-lowering operation amount is less than the predetermined operation amount A6, the hydraulic pressure in the second pump flowpath 34 is kept at a lower pressure than the relief pressure Pr of the relief valve 43. Furthermore, when the boom-lowering operation amount is smaller than a predetermined operation amount A6, the hydraulic pressure in the second pump flowpath 34 increases to within less than the relief pressure Pr in accordance with an increase in the boom-lowering operation amount.

Finally, as illustrated in FIG. 3, when the boom-lowering operation amount is smaller than the predetermined operation amount A2, the bleed-off opening area remains constant at b1. When the bleed-off opening area remains constant, the control valve 16 is set to a position between the neutral position Pn and the third position state P3.

Next, one example of the flow of the hydraulic fluid during a bleed off is described based on FIG. 2. The ratio of the pressure receiving area of the cylinder rod 14*a* in the first chamber 14*c*, and the pressure receiving area of the cylinder rod 14*a* in the second chamber 14*d* is assumed to be 2:1. When the work implement 2 is descending, the hydraulic fluid is supplied to the second chamber 14*d* to cause the hydraulic cylinder 14 to contract. For example, when the inflow rate from the second cylinder flowpath 32 to the second chamber 14*d* is 0.8, the outflow rate from the first chamber 14*c* to the first cylinder flowpath 31 is 1.6. In the following description, the values indicating the flow rate are examples of the division of flows in each flowpath.

The discharge flow rate of the first hydraulic pump 12 and the discharge flow rate of the second hydraulic pump 13 are assumed to be 1.0 respectively. In this case the flow rate in the second pump flowpath 34 is 1.0. The pump controller 24 sets the control valve 16 to a position state between the second position state P2 and the third position state P3 so that the size of the bleed-off opening area is proportionate to the boom-lowering operation amount. Consequently, a 0.2 portion of the hydraulic fluid in the second pump flowpath 34 flows into the bleed-off flowpath 37. The flow rate of the hydraulic fluid sent to the bleed-off flowpath 37 is defined by the bleed-off opening area. The remaining 0.8 portion of the hydraulic fluid passes through the second cylinder flowpath 32 and flows into the second chamber 14*d* of the hydraulic cylinder 14.

When the hydraulic cylinder 14 contracts and the work implement 2 descends, a 1.6 portion of the hydraulic fluid is expelled from the first chamber 14*c* of the hydraulic cylinder 14. The 1.6 portion of the hydraulic fluid flows through the first cylinder flowpath 31 and into the first pump flowpath 33.

Whereas, the 0.2 portion of the hydraulic fluid from the bleed-off flowpath 37 combines with a 0.2 portion of the hydraulic fluid in the charge circuit 35 coming from the charge pump 28. A total of a 0.4 portion of the hydraulic fluid flows from the charge circuit 35 into the first pump flowpath 33.

The 1.6 portion of the hydraulic fluid from the first cylinder flowpath 31 combines with the 0.4 portion of the hydraulic fluid from the charge circuit 35 in the first pump flowpath 33. A 1.0 portion of the hydraulic fluid from the first pump flowpath 33 returns to both the first hydraulic pump 12 and the second hydraulic pump 13 because the first hydraulic pump 12 and the second hydraulic pump 13 are set to have the same capacity.

The hydraulic drive system according to this exemplary embodiment has the following features.

When the boom-lowering operation amount of the operating member 46*a* is less than the predetermined operation amount A6, the second pump flowpath 34 is connected to the bleed-off flowpath 37 via the throttle 17. Thus, a portion of the hydraulic fluid in the second pump flowpath 34 is bled off into the bleed-off flowpath 37, and the hydraulic pressure in the second pump flowpath 34 is kept within the relief pressure. Therefore, the acceleration used to lower the work implement 2 can be controlled. This facilitates the operator's adjusting the position of the work implement 2 to the desired height.

When the boom-lowering operation amount of the operating member 46*a* is at the predetermined operation amount A6 or greater, the opening between the second pump flowpath 34 and the bleed-off flowpath 37 is closed. Accordingly, when the boom-lowering operation amount is at the predetermined operation amount A6 or greater, all the hydraulic fluid in the second pump flowpath 34 is supplied to the second chamber 14*d* in the hydraulic cylinder 14 via the second cylinder flowpath 32. As a result, the work implement 2 may be lowered rapidly. Consequently, this improves the work efficiency of the work implement 2.

When the boom-lowering operation amount of the operating member 46*a* is less than the predetermined operation amount A6, the bleed-off opening area is adjusted so that the hydraulic pressure in the second pump flowpath 34 increases in accordance with an increase in the boom-lowering operation amount. Thus, the hydraulic pressure in the second pump flowpath 34 increases in accordance with an increase in the boom-lowering operation amount even when the boom-lowering operation amount is less than the predetermined operation amount A6. Therefore, the operator can adjust the operation speed of the work implement 2 using the operating member 46*a*.

The hydraulic fluid that is bled off returns to the hydraulic pumps 12, 13 via the charge circuit 35. Accordingly, the hydraulic fluid that is bled off may be reused in the hydraulic pumps 12, 13.

Second Exemplary Embodiment

Figure 5:
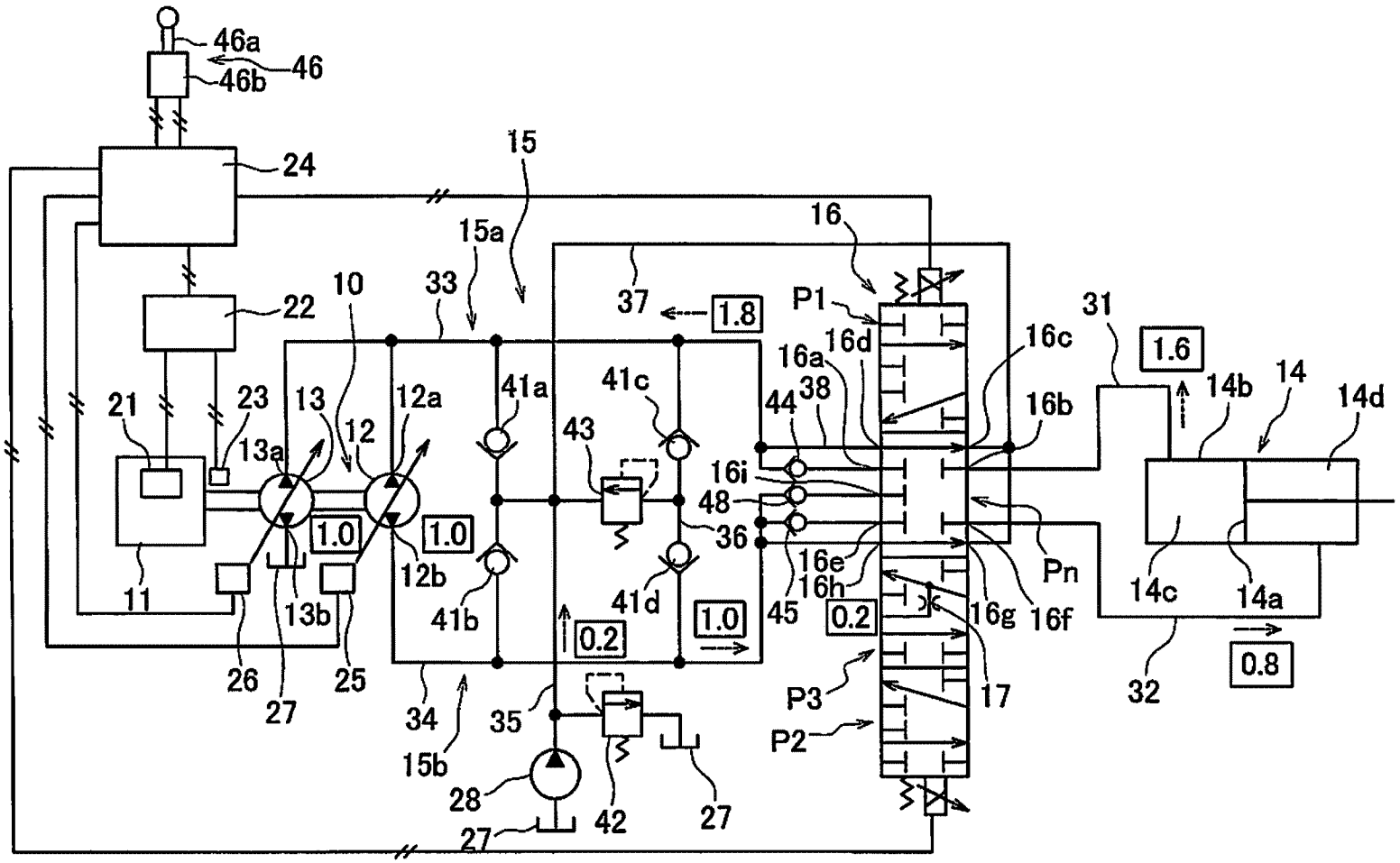
FIG. 5 is a block diagram of a configuration of the hydraulic drive system according to a second exemplary embodiment.

FIG. 5 illustrates a hydraulic drive system according to a second exemplary embodiment of the present invention. The hydraulic drive system according to the second exemplary embodiment includes a third bleed-off port 16*i* in the control valve 16. The third bleed-off port 16*i* is connected to the second pump flowpath 34 via a third direction control section 48. The third direction control section 48 allows the hydraulic fluid to flow from the second pump flowpath 34 to the third bleed-off port 16*i*, and prevents the hydraulic fluid from flowing from the third bleed-off port 16*i* into the second pump flowpath 34.

Additionally, in the third position state P3, the control valve 16 links the third bleed-off port 16*i* and the first bypass port 16*d* via the throttle 17. Accordingly, when the control valve 16 is in the third position state P3 the control valve 16 connects the second pump flowpath 34 to a flowpath 38 via the throttle 17. The flowpath 38 connects the first bypass port 16*d* and the first pump flowpath 33. That is, in the second exemplary embodiment the flowpath 38, which connects the first bypass port 16*d* and the first pump flowpath 33, corresponds to a bleed-off flowpath.

In the third position state P3, the control valve 16 links the first-cylinder port 16*f* and the first bypass port 16*d* and links the second-pump port 16*e* and the second-cylinder port 16*b*. Accordingly, when the control valve 16 is in the third position state P3, a portion of the hydraulic fluid in the second pump flowpath 34 combines with the hydraulic fluid in the first cylinder flowpath 31, and flows into the first pump flowpath 33. Other configurations of the hydraulic drive system according to the second exemplary embodiment are the same as the configurations of the hydraulic drive system according to the first exemplary embodiment.

Next, an example of the flow of the hydraulic fluid during bleed-off control in the hydraulic drive system according to the second exemplary embodiment is described based on FIG. 5. The discharge flow rate of the first hydraulic pump 12 and the discharge flow rate of the second hydraulic pump 13, are 1.0 respectively. In this case the flow rate in the second pump flowpath 34 is 1.0. The pump controller 24 sets the control valve 16 in a position state between the second position state P2 and the third position state P3 so that the bleed-off opening area is proportionate to the boom-lowering operation amount. The bleed-off opening area is an opening area between the third bleed-off port 16*i* and the first bypass port 16*d*.

When the control valve 16 is set as above mentioned, 0.2 portion of the hydraulic fluid in the second pump flowpath 34 flows into the bleed-off port 16*i*. The remaining 0.8 portion of the hydraulic fluid passes through the second cylinder flowpath 32 and flows into the second chamber 14*d* in the hydraulic cylinder 14.

When the hydraulic cylinder 14 contracts and the work implement 2 descends, 1.6 portion of the hydraulic fluid is expelled from the first chamber 14*c* of the hydraulic cylinder 14. The 1.6 portion of the hydraulic fluid passes through the first cylinder flowpath 31 and flows into the first pump flowpath 33. In the meantime, the 0.2 portion of the hydraulic fluid from the third bleed-off port 16*i* combines with the 1.6 portion of the hydraulic fluid from the first cylinder flowpath 31. The total 1.8 portion of the hydraulic fluid passes through the flowpath 38, and flows into the first pump flowpath 33. On the other hand, 0.2 portion of the hydraulic fluid from the charge circuit 35 is supplied to the first pump flowpath 33.

The 1.8 portion of the hydraulic fluid from the flowpath 38 combines with the 0.2 portion of the hydraulic fluid from the charge circuit 35 in the first pump flowpath 33. 1.0 portion of the hydraulic fluid from the first pump flowpath 33 returns to both the first hydraulic pump 12 and the second hydraulic pump 13 because the first hydraulic pump 12 and the second hydraulic pump 13 are set to have the same capacity.

As above described, the hydraulic drive system according to the second embodiment exhibits the same effects as the hydraulic drive system according to the first exemplary embodiment.

Third Exemplary Embodiment

Figure 6:
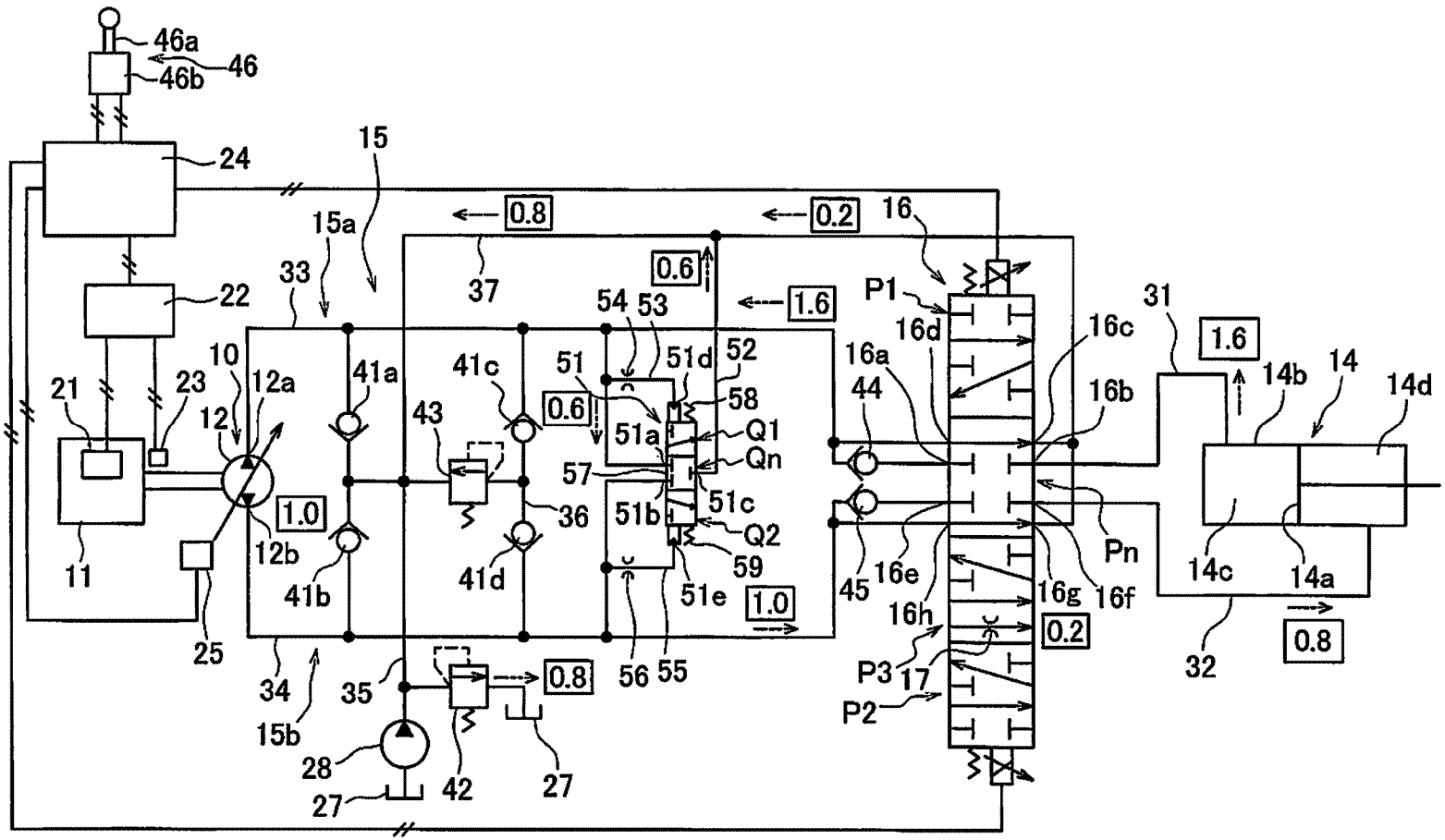
FIG. 6 is a block diagram of a configuration of the hydraulic drive system according to a third exemplary embodiment.

FIG. 6 illustrates a hydraulic drive system according to a third exemplary embodiment of the present invention. The hydraulic drive system according to the third exemplary embodiment excludes the second hydraulic pump 13 in the hydraulic drive system according to the first exemplary embodiment. Accordingly, the main pump 10 is configures by a single hydraulic pump (the first hydraulic pump 12). Furthermore, the hydraulic drive system according to the third exemplary embodiment includes a shuttle valve 51.

The shuttle valve 51 includes a first input port 51*a*, second input port 51*b*, a drain port 51*c*, a first pressure receiver 51*d*, and a second pressure receiver 51*e*. The first input port 51*a* is connected to the first flowpath 15*a*. The second input port 51*b* is connected to the second flowpath 15*b*. More specifically, the first input port 51*a* is connected to the first pump flowpath 33. The second input port 51*b* is connected to the second pump flowpath 34. The drain port 51*c* is connected to a drain flowpath 52. The drain flowpath 52 is connected to the charge circuit 35 via the bleed-off flowpath 37. The first pressure receiver 51*d* is connected to the first flowpath 15*a* via a first pilot flowpath 53. Thus, the hydraulic pressure in the first flowpath 15*a* is applied to the first pressure receiver 51*d*. A throttle 54 is arranged in the first pilot flowpath 53. The second pressure receiver 51*e* is connected to the second flowpath 15*b* via a second pilot flowpath 55. Thus, the hydraulic pressure in the second flowpath 15*b* is applied to the second pressure receiver 51*e*. A throttle 56 is arranged in the second pilot flowpath 55.

The shuttle valve 51 can be switched between a first position state Q1, a second position state Q2, and a neutral position state Qn in accordance with the hydraulic pressure in the first flowpath 15*a* and the hydraulic pressure in the second flowpath 15*b*. In the first position state Q1, the shuttle valve 51 links the second input port 51*b* and the drain port 51*c*. Thus, the second flowpath 15*b* is connected to the drain flowpath 52. In the second position state Q2, the shuttle valve 51 links the first input port 51*a* and the drain port 51*c*. Thus, the first flowpath 15*a* is connected to the drain flowpath 52. In the neutral position state Qn, the shuttle valve 51 blocks the flows among the first input port 51*a*, the second input port 51*b*, and the drain port 51*c*.

The shuttle valve 51 includes a spool 57, a first elastic element 58, and a second elastic element 59. The first elastic element 58 pushes the spool 57 from the side of the first pressure receiver 51*d* toward the side of the second pressure receiver 51*e*. The second elastic element 59 pushes the spool 57 from the side of the second pressure receiver 51*e* toward the first pressure receiver 51*d*. The first elastic element 58 is attached to the spool 57 with the first elastic element 58 contracted from the natural length of the first elastic element 58. The first elastic element 58 is attached to the spool 57 in such a way that the first elastic element 58 presses the spool 57 with applying a first attachment load to the spool 57 when the spools 57 is in a neutral position. The second elastic element 59 is attached to the spool 57 with the first elastic element 59 contracted from the natural length of the second elastic element 59. The second elastic element 59 presses the spool 57 with applying a second attachment load to the spool 57 when the spool 57 is in the neutral position.

The ratio of the pressure receiving area of the first pressure receiver 51*d* and the pressure receiving area of the second pressure receiver 51*e* is equivalent to the ratio of the pressure receiving area of the first chamber 14*c* and the pressure receiving area of the second chamber 14*d*. For instance, when the pressure receiving area the ratio of the pressure receiving area of the first chamber 14*c* and the pressure receiving area of the second chamber 14*d* is 2:1, then the ratio of the pressure receiving area of the first pressure receiver 51*d* and the pressure receiving area of the second pressure receiver 51*e* is 2:1.

When the force applied to the first pressure receiver 51*d* due to the hydraulic pressure in the first flowpath 15*a* is greater than the force applied to the second pressure receiver 51*e* due to the hydraulic pressure in the second flowpath 15*b*, the shuttle valve 51 switches to the first position state Q1. Thus, the second flowpath 15*b* and the drain flowpath 52 are connected. As a result, a portion of the hydraulic fluid in the second flowpath 15*b* flows into the charge circuit 35 via the drain flowpath 52 and the bleed-off flowpath 37. When the force applied to the second pressure receiver 51*e* due to the hydraulic pressure in the second flowpath 15*b* is greater than the force applied to the first pressure receiver 51*d* due to the hydraulic pressure in the first flowpath 15*a*, the shuttle valve 51 switches to the second position state Q2. Thus, the first flowpath 15*a* and the drain flowpath 52 are connected. As a result, a portion of the hydraulic fluid in the first flowpath 15*a* flows into the charge circuit 35 via the drain flowpath 52 and the bleed-off flowpath 37.

Other configurations in the hydraulic drive system according to the third exemplary embodiment are the same as the configurations in the hydraulic drive system according to the first exemplary embodiment. Next, an example of the flow of the hydraulic fluid in the hydraulic drive system according to the third exemplary embodiment during bleed-off control is described based on FIG. 6.

The discharge flow rate of the first hydraulic pump 12 is assumed to be 1.0. In this case, the flow rate in the second pump flowpath 34 is 1.0. The pump controller 24 sets the control valve 16 to a position state between the second position state P2 and the third position state P3 so that the size of the bleed-off opening area is proportionate to the boom-lowering operation amount. Consequently, 0.2 portion of the hydraulic fluid from the second pump flowpath 34 flows into the bleed-off flowpath 37. The remaining 0.8 portion of the hydraulic fluid passes through the second cylinder flowpath 32 and flows into the second chamber 14*d* of the hydraulic cylinder 14.

When the hydraulic cylinder 14 contracts and the work implement 2 descends, a 1.6 portion of the hydraulic fluid is expelled from the first chamber 14*c* of the hydraulic cylinder 14. The 1.6 portion of the hydraulic fluid passes through the first cylinder flowpath 31 and flows into the first pump flowpath 33.

When the hydraulic cylinder 14 contracts to cause the work implement 2 to descend, the shuttle valve 51 switches to the second position state Q2. A 0.6 portion of the hydraulic fluid in the first pump flowpath 33 passes through the shuttle valve 51 and flows into the bleed-off flowpath 37. The remaining 1.0 portion of the hydraulic fluid returns to the first hydraulic pump 12.

Moreover, a 0.2 portion of the hydraulic fluid from the second pump flowpath 34 is combined with the 0.6 portion of the hydraulic fluid from the shuttle valve 51 in the bleed-off flowpath 37 and flows into the charge circuit 35. The total 0.8 of the hydraulic fluid flows from the charge circuit 35 into the hydraulic fluid tank 27 through the relief valve 42.

As above described, the hydraulic drive system according to the third exemplary embodiment exhibits the same effects as the hydraulic drive system according to the first exemplary embodiment.

Fourth Exemplary Embodiment

Figure 7:
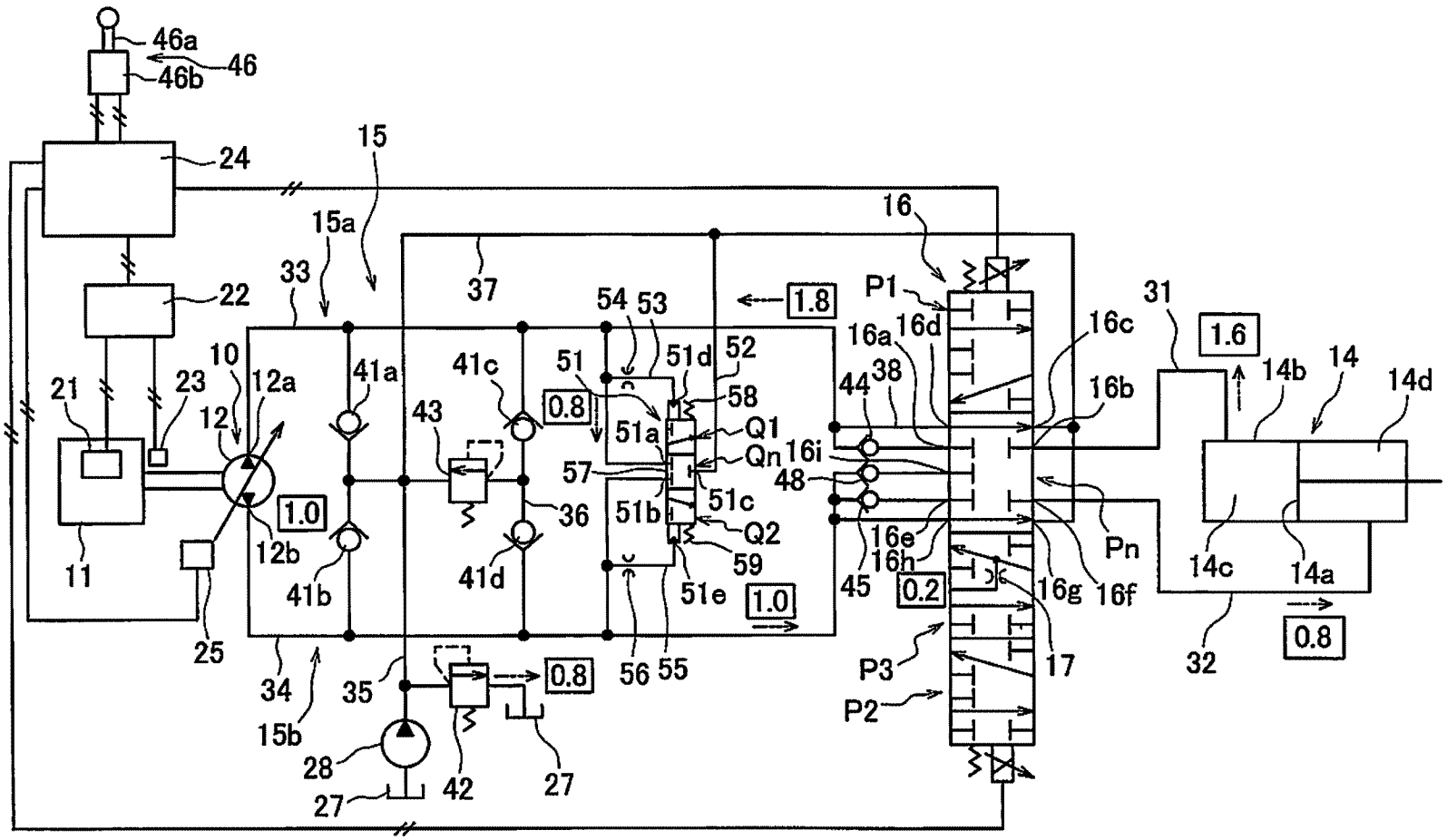
FIG. 7 is a block diagram of a configuration of the hydraulic drive system according to a fourth exemplary embodiment.

FIG. 7 illustrates a hydraulic drive system according to a fourth exemplary embodiment of the present invention. Similarly to the hydraulic drive system according to the third exemplary embodiment, the hydraulic drive system according to the fourth exemplary embodiment includes the main pump 10 in the hydraulic drive system according to the second exemplary embodiment configured with a single hydraulic pump (the first hydraulic pump 12). Furthermore, similarly to the hydraulic drive system according to the third exemplary embodiment, the hydraulic drive system according to the fourth exemplary embodiment includes a shuttle valve 51. Other configurations in the fourth exemplary embodiment are the same as in the hydraulic drive system of the second exemplary embodiment.

Next, an example of the flow of the hydraulic fluid during bleed-off control in the hydraulic drive system according to the fourth exemplary embodiment is described based on FIG. 7. The discharge flow rate of the first hydraulic pump 12 is assumed to be 1.0. In this case the flow rate in the second pump flowpath 34 is 1.0. The pump controller 24 sets the control valve 16 in a position between the second position state P2 and the third position state P3 so that the size of the bleed-off opening area is proportionate to the boom-lowering operation amount.

Consequently, 0.2 portion of the hydraulic fluid from the second pump flowpath 34 flows into the bleed-off port 16*i*. The remaining 0.8 portion of the hydraulic fluid passes through the second cylinder flowpath 32 and flows into the second chamber 14*d* in the hydraulic cylinder 14.

When the hydraulic cylinder 14 contracts and the work implement 2 descends, a 1.6 portion of the hydraulic fluid is expelled from the first chamber 14*c* of the hydraulic cylinder 14. The 1.6 portion of the hydraulic fluid passes through the first cylinder flowpath 31 and flows into the first pump flowpath 33. At this point, the 0.2 portion of the hydraulic fluid from the third bleed-off port 16*i* combines with the 1.6 portion of the hydraulic fluid from the first cylinder flowpath 31. The total 1.8 portion of the hydraulic fluid passes through the flowpath 38, and flows into the first pump flowpath 33.

When the hydraulic cylinder 14 contracts to cause the work implement 2 to descend, the shuttle valve 51 switches to the second position state Q2. 0.8 portion of the hydraulic fluid in the first pump flowpath 33 passes through the shuttle valve 51 and flows into the bleed-off flowpath 37. The remaining 1.0 portion of the hydraulic fluid returns to the first hydraulic pump 12.

Moreover, 0.8 portion of the hydraulic fluid from the shuttle valve 51 passes through the bleed-off flowpath 37 and flows into the charge circuit 35. The total 0.8 of the hydraulic fluid flows from the charge circuit 35 into the hydraulic fluid tank 27 through the relief valve 42.

As above described, the hydraulic drive system according to the fourth exemplary embodiment exhibits the same effects as the hydraulic drive system according to the first exemplary embodiment.

Fifth Exemplary Embodiment

Figure 8:
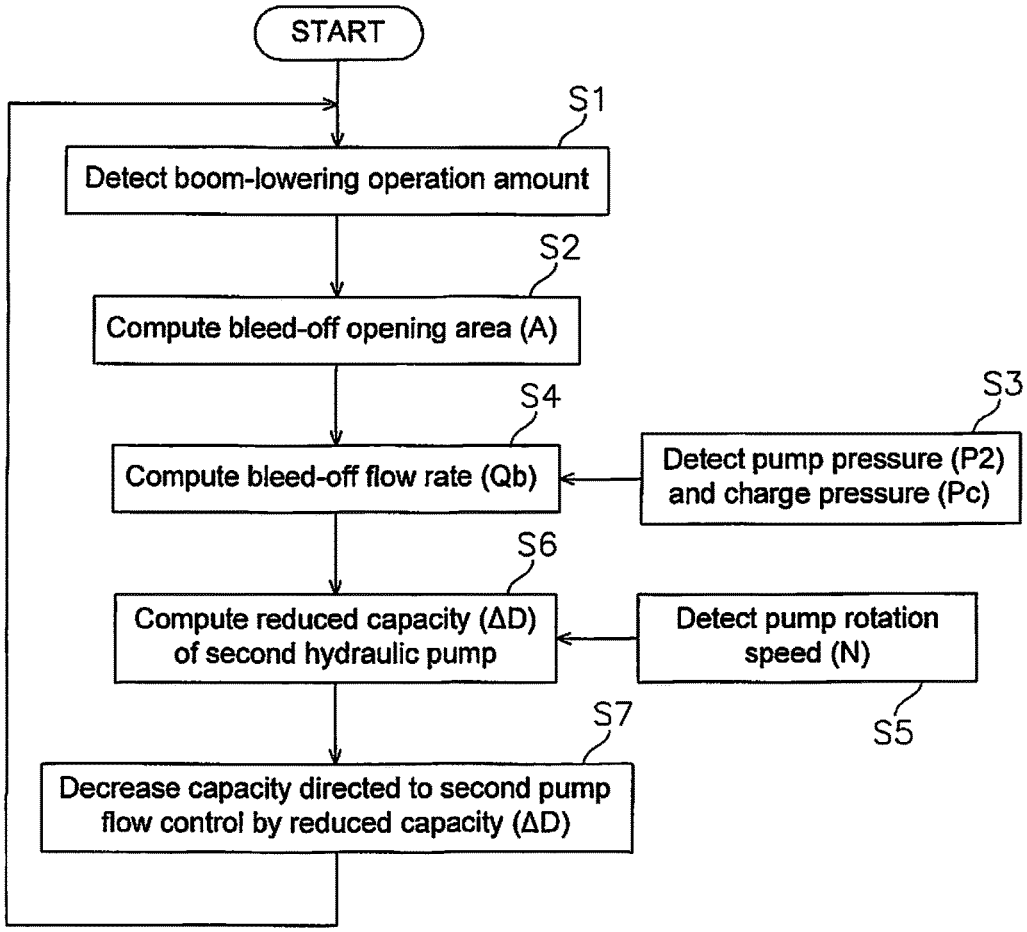
FIG. 8 is a flowchart illustrating the process of controlling the capacity directed to the hydraulic pump in the hydraulic drive system according to a fifth exemplary embodiment.

During normal control, the pump controller 24 controls the capacity directed to the first hydraulic pump 12 and the second hydraulic pump 13 to control the suction torque of the first hydraulic pump 12 and the suction torque of the second hydraulic pump 13 on the basis of the pump suction torque characteristics. However, when the boom-lowering operation amount is smaller than a predetermined operation amount A6, the pump controller 24 may subtract a capacity corresponding to the flow rate of the hydraulic fluid bled off from the second pump flowpath 34 from the capacity directed to the second hydraulic pump 13. FIG. 8 is a flowchart illustrating the process of controlling the capacity directed to the second hydraulic pump 13 in the hydraulic drive system according to the fifth exemplary embodiment.

In step S1, the pump controller 24 detects the boom-lowering operation amount. The pump controller 24 detects the boom-lowering operation amount using a detection signal from the operation detector 46*b*.

In step S2, the pump controller 24 computes a bleed-off opening area (A). The pump controller 24 computes the bleed-off opening area (A) from the boom-lowering operation amount on the basis of the bleed-off opening area information L2.

In step S3, the pump controller 24 detects a pump pressure (P2), and a charge pressure (Pc). The pump pressure (P2) is the hydraulic pressure in the second pump flowpath 34. The charge pressure (Pc) is a hydraulic pressure in the charge circuit 35. The pump controller 24 detects the pump pressure (P2) and the charge pressure (Pc) using a pressure sensor provided in the hydraulic circuit, for example.

In step S4, the pump controller 24 calculates the bleed-off flow rate (Qb). The bleed-off flow rate (Qb) is the rate of the hydraulic fluid bled off from the second pump flowpath 34. The pump controller 24 computes the bleed-off flow rate (Qb) from the following Formula 1.

$$Qb=CA\sqrt{P2-Pc} \qquad \text{Formula 1:}$$

Where C is a predetermined constant; A is the bleed-off opening area computed in step S2; P2 is the pump pressure detected in step S3; and Pc is the charge pressure detected in step S3.

In step S5, the pump controller 24 computes the pump rotation speed (N). The pump rotation speed (N) is the rotation speed of both the hydraulic pumps 12, 13. For example, the pump controller 24 computes the pump rotation speed (N) from the rotation speed of the engine 11 as detected by the rotation speed sensor 23.

In step S6, the pump controller 24 computes a reduced capacity (ΔD) of the second hydraulic pump 13. The pump controller 24 computes the reduced capacity (ΔD) of the second hydraulic pump 13 from the following Formula 2.

$$\Delta D = Qb/N \qquad \text{Formula 2:}$$

Where Qb is the bleed-off flow rate computed in step S4; and N is the pump rotation speed detected in step S5.

In step S7, the pump controller 24 reduces the capacity directed to the second hydraulic pump 13 by the reduced capacity (ΔD). The pump controller 24 sends a command signal corresponding to the capacity subtracting the reduced capacity (ΔD) from the directed capacity to the second hydraulic pump 13.

In the hydraulic drive system according to the fifth exemplary embodiment the charge flow rate, which is augmented from the charge pump 28, can be reduced. Thus, the fuel consumption of the drive source may be further improved. For instance, in the first exemplary embodiment when the flow rate into the bleed-off flowpath 37 is 0.2 as illustrated in FIG. 2, the flow of 0.2 does not travel through the hydraulic cylinder 14. Accordingly, the outflow rate from the hydraulic cylinder 14 does not increase from 0.2 to 0.4. Thus, the difference of 0.2 in the flow rate may be provided from the charge pump 28. In contrast, in the hydraulic drive system according to the fifth exemplary embodiment, the capacity of the second hydraulic pump is reduced by a capacity of 0.2. Therefore, there is no need to supplement the hydraulic fluid flowing in the first pump flowpath 33 from the charge pump 28. Thus, it is possible to reduce the flow rate of the charge pump 28.

Here ends the description of exemplary embodiments of the present invention. The present invention is not limited to these descriptions but may be modified in various ways and so far as the modifications do not deviate from the spirit of the present invention.

The hydraulic drive system is not limited to driving the boom of a hydraulic shovel, and may be used to drive other work implements in other types of work vehicles. For example, the hydraulic drive system may be used to drive the lift arm in a wheel loader. Alternatively the hydraulic drive system may be used to drive the blade of a bulldozer.

The drive source is not limited to an engine and may be an electric motor.

The control valve 16 may be a hydraulic control valve controlled using a pilot pressure. In this case, an electromagnetic proportional pressure-reducing valve may be arranged between the pump controller 24 and the hydraulic control valve. The pump controller 24 uses a command signal to control the electromagnetic proportional pressure-reducing valve. The electromagnetic proportional pressure-reducing valve supplies the hydraulic control valve with a pilot pressure in accordance with the command signal. The hydraulic control valve may switch controls in accordance with the pilot pressure. The electromagnetic proportional pressure-reducing valve reduces the pressure of the hydraulic fluid discharged from the pilot pump and generates a pilot pressure. The hydraulic fluid discharged from the charge pump 28 may be used instead of the hydraulic fluid discharged from the pilot pump.

In the above-mentioned embodiments the bleed-off flowpath 37 is connected to the charge circuit 35; however, the bleed-off flowpath 37 may be connected to another element in the circuit such as the hydraulic fluid tank 27. However, when the bleed-off flowpath 37 is connected to the hydraulic fluid tank 27, the hydraulic fluid from the bleed-off flowpath 37 cannot be reused in the hydraulic pumps 12, 13. Therefore, the charge pump 28 needs to be enlarged. Consequently, it is preferable that the bleed-off flowpath 37 is connected to the charge circuit 35.

In the above-mentioned exemplary embodiments, the pump controller 24 carries out normal control and low-speed control. However, these controls may be omitted. For instance, the low-speed control may be omitted.

In the above-mentioned exemplary embodiments, the predetermined operation amount A6 is a value less than 100%. However, the predetermined operation amount may be 100%.

The present invention provides a hydraulic drive system that facilitates adjusting the position of a work implement to a desired height.

The invention claimed is:

1. A hydraulic drive system comprising:

a hydraulic pump including a first pump port and a second pump port, the hydraulic pump being switchable between a discharge state in which hydraulic fluid is taken in from the second pump port and the hydraulic fluid is discharged from the first pump port, and a discharge state in which the hydraulic fluid is taken in from the first pump port and the hydraulic fluid is discharged from the second pump port;

a drive source for driving the hydraulic pump;

a work implement;

a hydraulic cylinder driven by the hydraulic fluid discharged from the hydraulic pump, the hydraulic cylinder including a first chamber and a second chamber, the hydraulic cylinder configured to lower the work implement when the hydraulic fluid is expelled from the first chamber and supplied to the second chamber, and to raise the work implement when the hydraulic fluid is supplied to the first chamber and expelled from the second chamber;

a hydraulic fluid flowpath including a first flowpath connecting the first pump port and the first chamber, and a second flowpath connecting the second pump port and the second chamber, the hydraulic fluid flowpath forming a closed circuit between the hydraulic pump and the hydraulic cylinder;

a relief valve configured to open when the hydraulic pressure in the hydraulic fluid flowpath is equal to or greater than a relief pressure;

an operating member for operating the work implement;

a bleed-off flowpath for bleeding off a portion of the hydraulic fluid from the second flowpath; and a control valve configured to connect the second flowpath to the bleed-off flowpath via a throttle to maintain the hydraulic pressure in the second flowpath at less than the relief pressure when an operation amount of the operating member during lowering the work implement is smaller than a predetermined operation amount, the predetermined operation amount being less than or equal to a maximum operation amount, the control valve being further configured to close the connection between the second flowpath and the bleed-off flowpath when the operation amount of the operating member is greater than or equal to the predetermined operation amount.

2. The hydraulic drive system according to claim 1, wherein the control valve adjusts an opening area of an opening between the second flowpath and the bleed-off flowpath such that the hydraulic pressure in the second flowpath increases in accordance with an increase in the operation amount of the operating member when the operation amount of the operating member is less than the predetermined operation amount.

3. The hydraulic drive system according to claim 1, further comprising a charge circuit for supplementing the hydraulic fluid in the hydraulic fluid flowpath, the bleed-off flowpath being connected to the charge circuit.

4. The hydraulic drive system according to claim 1, further comprising a hydraulic fluid tank for storing hydraulic fluid, the bleed-off flowpath being connected to the hydraulic fluid tank.

5. The hydraulic drive system according to claim 1, further comprising a pump controller configured to control the hydraulic pump, the hydraulic pump including a first hydraulic pump and a second hydraulic pump, at least the second hydraulic pump being a variable capacity hydraulic pump, the pump controller being configured such that when the operation amount of the operating member is less than the predetermined operation amount, the pump controller reduces a capacity of the second hydraulic pump by an amount corresponding to a flow rate of the hydraulic fluid diverted to the bleed-off flowpath from the second flowpath.

6. The hydraulic drive system according to claim 5, wherein the control valve adjusts an opening area of an opening between the second flowpath and the bleed-off flowpath such that the hydraulic pressure in the second flowpath increases in accordance with an increase in the operation amount of the operating member when the operation amount of the operating member is less than the predetermined operation amount.

7. The hydraulic drive system according to claim 6, further comprising a charge circuit for supplementing the hydraulic fluid in the hydraulic fluid flowpath;

the bleed-off flowpath being connected to the charge circuit.

8. The hydraulic drive system according to claim 6, wherein the bleed-off flowpath is connected to the first flowpath.

9. The hydraulic drive system according to claim 6, further comprising a hydraulic fluid tank for storing hydraulic fluid, the bleed-off flowpath being connected to the hydraulic fluid tank.

10. A hydraulic drive system comprising:

a hydraulic pump including a first pump port and a second pump port, the hydraulic pump being switchable between a discharge state in which hydraulic fluid is taken in from the second pump port and the hydraulic fluid is discharged from the first pump port, and a discharge state in which the hydraulic fluid is taken in from the first pump port and the hydraulic fluid is discharged from the second pump port, the hydraulic pump including a first hydraulic pump and a second hydraulic pump, at least the second hydraulic pump being a variable capacity hydraulic pump;

a drive source for driving the hydraulic pump;

a work implement;

a hydraulic cylinder driven by the hydraulic fluid discharged from the hydraulic pump, the hydraulic cylinder including a first chamber and a second chamber, the hydraulic cylinder configured to lower the work implement when the hydraulic fluid is expelled from the first chamber and supplied to the second chamber, and to raise the work implement when the hydraulic fluid is supplied to the first chamber and expelled from the second chamber;

a hydraulic fluid flowpath including a first flowpath connecting the first pump port and the first chamber, and a second flowpath connecting the second pump port and the second chamber, the hydraulic fluid flowpath forming a closed circuit between the hydraulic pump and the hydraulic cylinder;

a relief valve configured to open when the hydraulic pressure in the hydraulic fluid flowpath is equal to or greater than a relief pressure;

an operating member for operating the work implement;

a bleed-off flowpath for bleeding off a portion of the hydraulic fluid from the second flowpath;

a control valve configured to connect the second flowpath to the bleed-off flowpath via a throttle to maintain the hydraulic pressure in the second flowpath at less than the relief pressure when an operation amount of the operating member during lowering the work implement is smaller than a predetermined operation amount, the predetermined operation amount being less than or equal to a maximum operation amount; and a pump controller configured to control the hydraulic pump, the pump controller being configured such that when the operation amount of the operating member is less than the predetermined operation amount, the pump controller reduces a capacity of the second hydraulic pump by an amount corresponding to a flow rate of the hydraulic fluid diverted to the bleed-off flowpath from the second flowpath.

11. The hydraulic drive system according to claim 10, wherein the control valve adjusts an opening area of an opening between the second flowpath and the bleed-off flowpath such that the hydraulic pressure in the second flowpath increases in accordance with an increase in the operation amount of the operating member when the operation amount of the operating member is less than the predetermined operation amount.

12. The hydraulic drive system according to claim 11, further comprising a charge circuit for supplementing the hydraulic fluid in the hydraulic fluid flowpath;

the bleed-off flowpath being connected to the charge circuit.

13. The hydraulic drive system according to claim 11, wherein the bleed-off flowpath is connected to the first flowpath.

14. The hydraulic drive system according to claim 11, further comprising a hydraulic fluid tank for storing hydraulic fluid, the bleed-off flowpath being connected to the hydraulic fluid tank.

15. A hydraulic drive system comprising:

a hydraulic pump including a first pump port and a second pump port, the hydraulic pump being switchable between a discharge state in which hydraulic fluid is taken in from the second pump port and the hydraulic fluid is discharged from the first pump port, and a discharge state in which the hydraulic fluid is taken in from the first pump port and the hydraulic fluid is discharged from the second pump port;

a drive source for driving the hydraulic pump;

a work implement;

a hydraulic cylinder driven by the hydraulic fluid discharged from the hydraulic pump, the hydraulic cylinder including a first chamber and a second chamber, the hydraulic cylinder configured to lower the work implement when the hydraulic fluid is expelled from the first chamber and supplied to the second chamber, and to raise the work implement when the hydraulic fluid is supplied to the first chamber and expelled from the second chamber;

a hydraulic fluid flowpath including a first flowpath connecting the first pump port and the first chamber, and a second flowpath connecting the second pump port and the second chamber, the hydraulic fluid flowpath forming a closed circuit between the hydraulic pump and the hydraulic cylinder;

a relief valve configured to open when the hydraulic pressure in the hydraulic fluid flowpath is equal to or greater than a relief pressure;

an operating member for operating the work implement;

a bleed-off flowpath for bleeding off a portion of the hydraulic fluid from the second flowpath, the bleed-off flowpath being connected to the first flowpath; and a control valve configured to connect the second flowpath to the bleed-off flowpath via a throttle to maintain the hydraulic pressure in the second flowpath at less than the relief pressure when an operation amount of the operating member during lowering the work implement is smaller than a predetermined operation amount, the predetermined operation amount being less than or equal to a maximum operation amount.

16. The hydraulic drive system according to claim 15, wherein the control valve adjusts an opening area of an opening between the second flowpath and the bleed-off flowpath such that the hydraulic pressure in the second flowpath increases in accordance with an increase in the operation amount of the operating member when the operation amount of the operating member is less than the predetermined operation amount.

17. The hydraulic drive system according to claim 16, further comprising a charge circuit for supplementing the hydraulic fluid in the hydraulic fluid flowpath;

the bleed-off flowpath being connected to the charge circuit.

18. The hydraulic drive system according to claim 16, wherein the bleed-off flowpath is connected to the first flowpath.

19. The hydraulic drive system according to claim 16, further comprising a hydraulic fluid tank for storing hydraulic fluid, the bleed-off flowpath being connected to the hydraulic fluid tank.

* * * * *